US005960603A

United States Patent [19]

Redden et al.

[11] Patent Number: 5,960,603

[45] Date of Patent: Oct. 5, 1999

[54] DRYWALL PATCH DEVICE

[75] Inventors: Joan Redden; Joan V. Rawley, both of Gwinhurst, Del.

[73] Assignee: Whole Remedy, Inc., Chester, Pa.

[21] Appl. No.: 09/019,408

[22] Filed: Feb. 5, 1998

Related U.S. Application Data

[60] Provisional application No. 60/036,918, Feb. 6, 1997.

[51] Int. Cl.[6] ..... E04G 23/02

[52] U.S. Cl. ..... 52/514

[58] Field of Search ..... 52/514, 514.5, 52/365, 127.1, 345

[56] References Cited

U.S. PATENT DOCUMENTS

| | | | |
|---|---|---|---|
| 4,100,712 | 7/1978 | Hyman | 52/514 |
| 4,135,017 | 1/1979 | Hoffmann | 52/514 X |
| 4,311,656 | 1/1982 | Spriggs | 52/514 X |
| 4,370,842 | 2/1983 | Martin et al. | 52/514 |
| 4,406,107 | 9/1983 | Schoonbeck | 52/514 |
| 4,620,407 | 11/1986 | Schmidt . | |
| 4,707,391 | 11/1987 | Hoffmann | 52/514 X |
| 4,715,151 | 12/1987 | Garblik . | |
| 4,759,812 | 7/1988 | Miller | 56/98 |
| 4,959,251 | 9/1990 | Owens et al. | 52/514 X |
| 4,989,385 | 2/1991 | McCullough . | |
| 5,269,861 | 12/1993 | Gilbreath | 52/514 X |
| 5,620,768 | 4/1997 | Hoffmann | 52/514 X |
| 5,687,528 | 11/1997 | Rouch | 52/514 X |
| 5,778,624 | 7/1998 | Russell | 52/514 |

*Primary Examiner*—Beth Aubrey
*Attorney, Agent, or Firm*—Eugene E. Renz, Jr. PC

[57] ABSTRACT

A patch device for repairing holes in drywall or the like having at least one pair of straight-sided edges, comprising, a body portion made of a flexible material having at least one pair of generally parallel spaced-straight sides and a series of teeth-like projections extending from opposing sides of the body portion engagable in the pair of edges of the opening in the drywall. The body portion is hinged to permit flexing the body portion to facilitate installation of the patch device in the opening in the drywall.

4 Claims, 8 Drawing Sheets

DRYWALL PATCH DEVICE

This application claims the benefit of U.S. Provisional Application No. 60/036,918 filed Feb. 6, 1997.

FIELD OF THE INVENTION

The present invention relates to a device or product for fixing holes in walls made of drywall or plasterboard.

BACKGROUND OF THE INVENTION

The prior art discloses various devices and methods for patching holes. For example, the repair kit shown in Schmidt, U.S. Pat. No. 4,620,407 for METHOD FOR DRYWALL PATCHING, includes a template having a saw guide slot to shape the damaged area in such a way to create inwardly sloped or inclined surfaces to accommodate a plug having complementary tapered surfaces. The plug is inserted from one side of the opening and the sloped edges of the repair plug are filled with a patching compound.

McCullough, U.S. Pat. No. 4,989,385 for DEVICE FOR REPAIRING A HOLE IN A PLASTERBOARD WALL, shows another device for repairing a hole in plasterboard wall. The McCullough system essentially calls for trimming a hole to a rectangular pattern with a knife or a saw. Pilot screw holes are then drilled in the wall which conform in spacing to holes in a cover board which fits over the opening and can be painted to match the wall if desired.

The Garblik U.S. Pat. No. 4,715,151 for PLASTERBOARD REPAIR KIT shows a plasterboard repair kit comprising an inflatable member, a cartridge of compressed gas, such as carbon dioxide and a cartridge holder. The inflatable member is placed in the area behind the hole to be repaired and is of a diameter somewhat greater than the diameter of the hole. With the inflatable member in place, the hole in the plasterboard now has a backing surface to support the plaster or spackling compound to patch the hole.

SUMMARY OF THE INVENTION

With the foregoing in mind, it is an object of the present invention to provide a method and device for repairing holes in plasterboard walls or the like, which is characterized by novel features of construction and arrangement, facilitating ease of positioning of the device in a hole. The device also has application to support conduit or the like in walls of new construction.

BRIEF DESCRIPTION OF THE DRAWINGS

These and other objects of the present invention and the various details and features of the construction and operation thereof are hereinafter more fully set forth with reference to the accompanying drawings, wherein.

DESCRIPTION OF THE PREFERRED EMBODIMENTS

Figure 1:
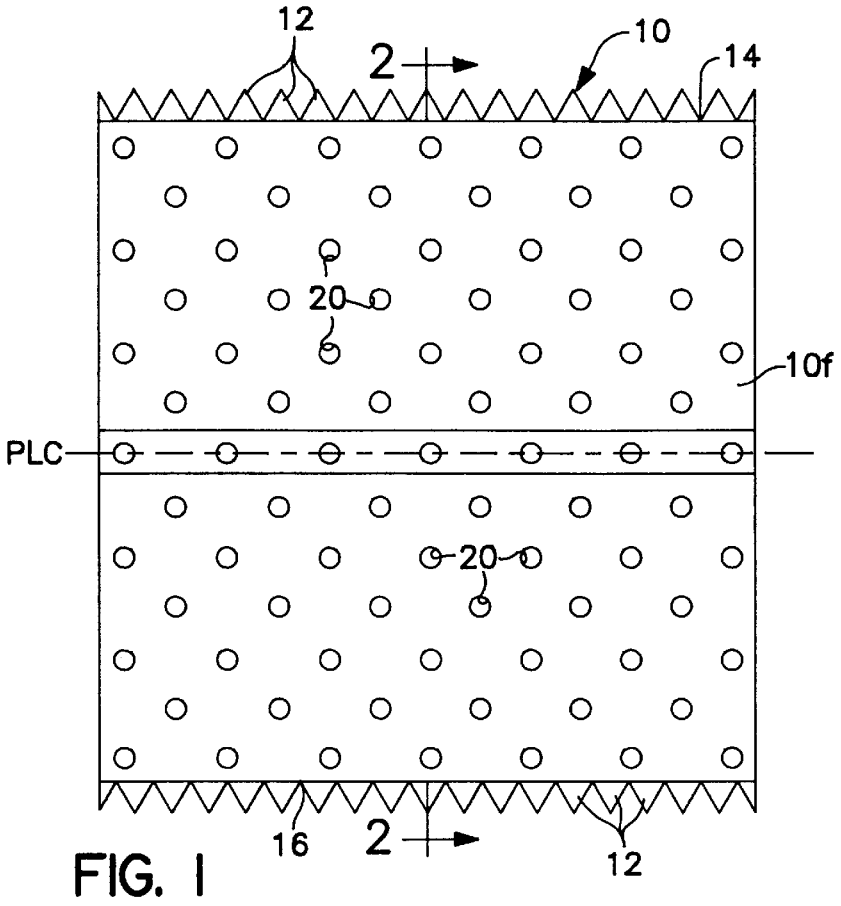
FIG. 1 is a plan view showing the drywall patch device of the present invention.
Figure 2:
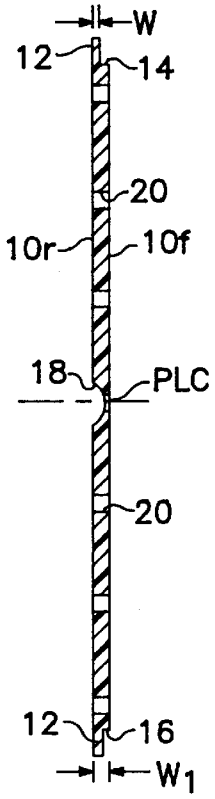
FIG. 2 is a transverse sectional view taken on lines 2—2 of FIG. 1.
Figure 3:
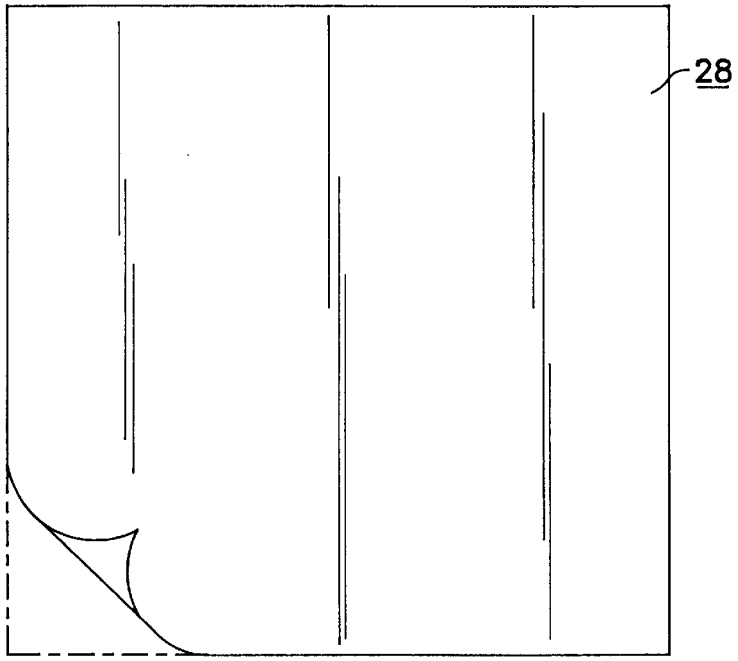
FIG. 3 is a plan view showing a template for sizing a damage hole in plasterboard or drywall wall sections.
Figure 4:
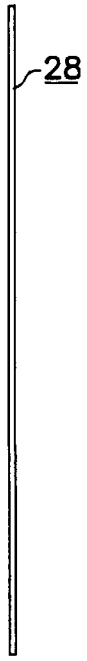
FIG. 4 is a end elevational view of the template of FIG. 3.
Figure 5:
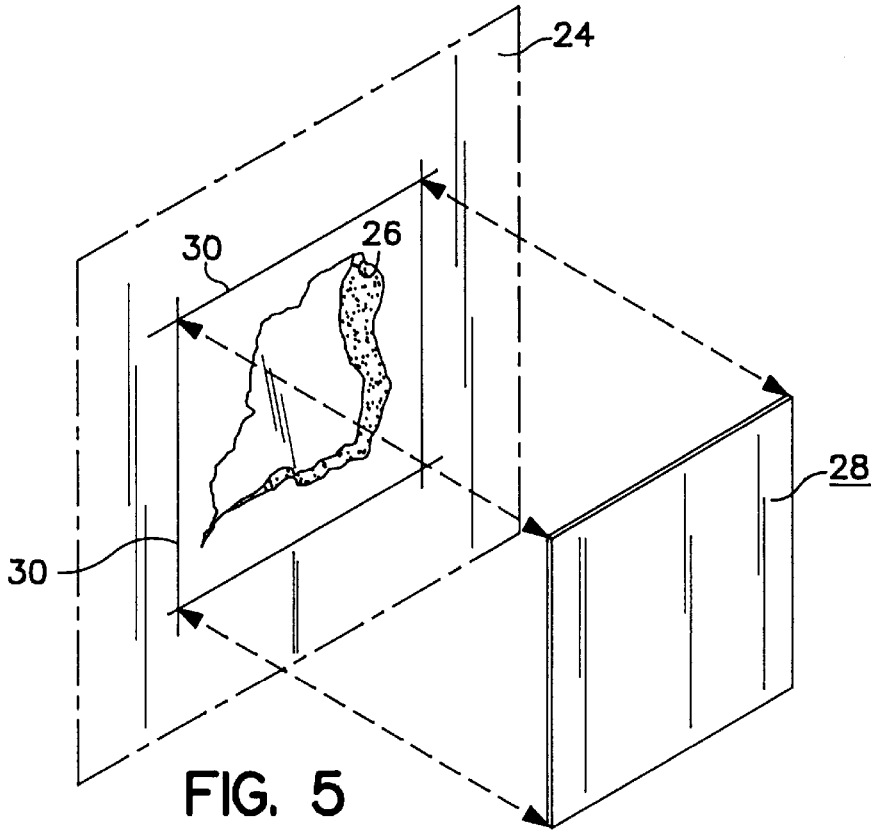
FIG. 5 is an exploded isometric view showing the template and a section of wall having a puncture hole therein.

Referring now to the drawings and particularly to FIG. 1 thereof, the patch device, generally designated by the numeral 10, is generally polygonal and in the illustrated embodiment is four-sided and square shaped. The patch device 10 is preferably made of a somewhat rigid, but pliable plastic material such as polyethylene and as best illustrated in FIGS. 1 and 2, comprises a main body portion $\mathbf{10}_a$ having series of teeth 12 projecting from opposing upper and lower side edges 14, 16 respectively. The patch element 10 has front face $\mathbf{10}_f$ and a rear face $\mathbf{10}_r$ the front face $\mathbf{10}_f$ of the patch element 10 presents a square outline. The teeth 12 as illustrated in FIG. 2 are flush with the front face and are of a transverse width W smaller than the transverse cross-width or thickness $W_1$ of the rectangular body portion $\mathbf{10}_a$ of the patch. The body portion $\mathbf{10}_a$ has a series of transverse openings 20 arranged in rows including a center row $R_c$ aligned with a groove 18 in one face of the body defining a hinge for flexing the device on installation as explained below.

Figure 6:
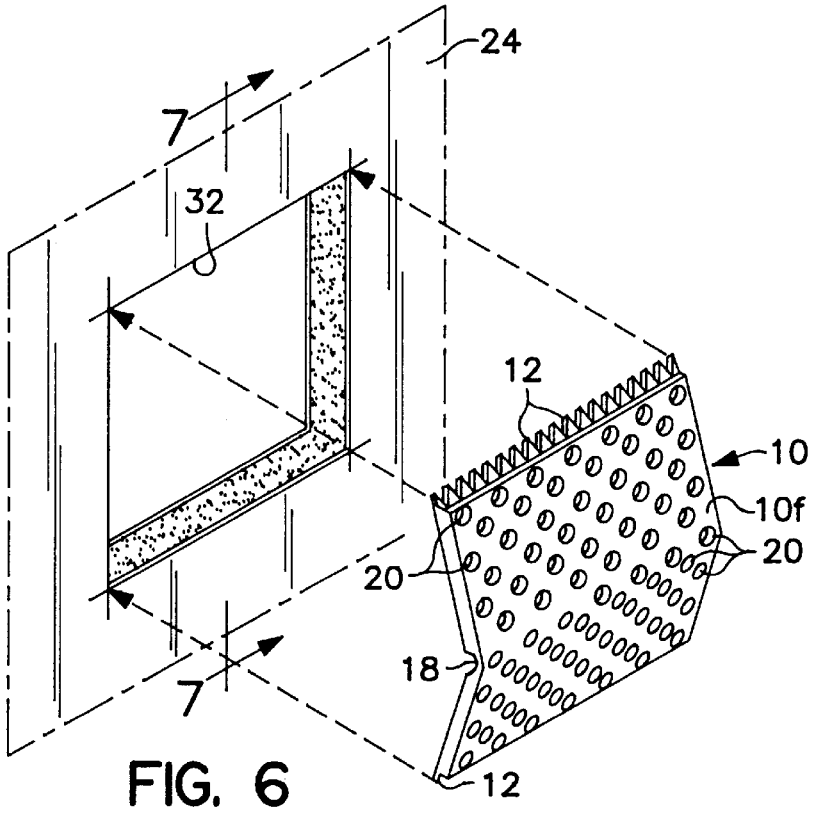
FIG. 6 is an exploded isometric view showing the sized opening in the drywall and the patch device positioned and flexed prior to insertion and fixing within the sized opening in the drywall.
Figure 7A:
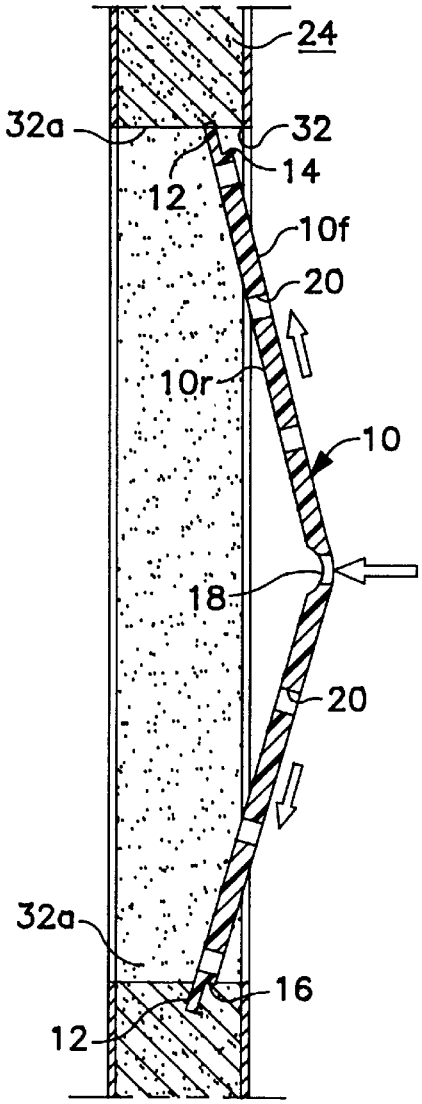
FIGS. 7A, 7B and 7C are enlarged transverse sectional views showing assembly or installation of the patch device in the sized opening in the wallboard.

Consider now use and installation of a wall patch element in accordance with the present invention. The damaged site, such as a hole 26 in a wallboard or drywall section 24, is prepared by positioning a template 28 over the hole 26 and scribing an area A surrounding the hole 26. A template approximately the size of the patch element 10 is used to define the area A. A square hole 32 is then formed by sawing the wallboard along the scribe lines 30 formed with the template 28. Thereafter, as illustrated in FIG. 6, the patch element 10 is bent along the living hinge 18 and positioned interiorly of the square opening 32 formed in the wall section 24 as shown in FIG. 7A. The lower row of teeth 12 are embedded first in the lower edge 32*e* of the square opening 32, as shown in FIG. 7A while the upper row of teeth 12 are positioned to engage against the upper edge $\mathbf{32}_u$ of the square opening 32. The patch element 10 is now in a flexed state of compression within the square opening 32. The flexed patch element is then pressed into a vertical mode driving the upper row of teeth 12 into the plaster of the dry wall and allowing the patch element 10 to return to its stable state which is planar or flat.

In this position, the teeth 12 on opposing edges 14, 16 of the body portion confront and engage the opposing parallel top and bottom surfaces $\mathbf{30}_e$, $\mathbf{32}_u$ of the square hole 32 in the dry wall section 24. The user simply then presses the patch element 10 on the front face opposite the hinge 18 so that the teeth 12 penetrate the wall board 24 in the manner shown in FIG. 7B.

Figure 7B:
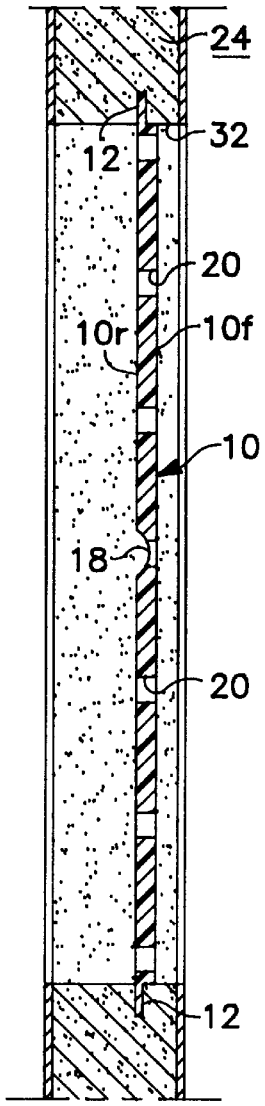
Figure 7C:
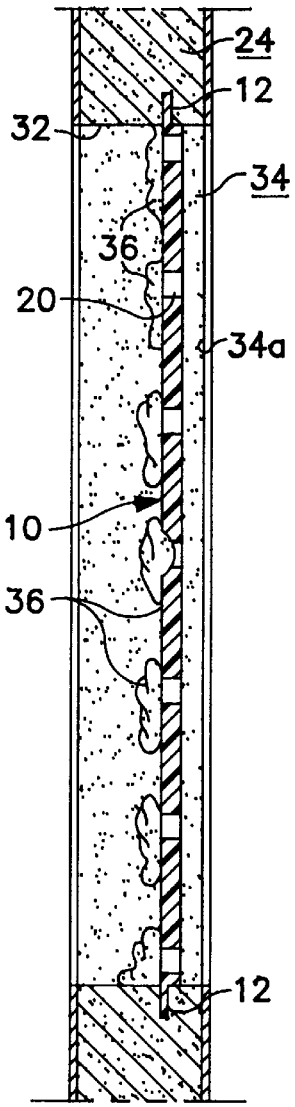

Wet plaster 34 is then applied to the front face of the patch element 10 in the manner shown in FIG. 7C, the holes 20 forming keys mushroom heads or plaster nails 36 for the wet plaster. The wet plaster 34 penetrates the holes 20 and forms mushroom heads 36 (FIG. 7C), which are referred to in the trade as plaster nails. These plaster nails or mushroom heads act as anchors for the plaster and lock the patch $^{34}{}_a$ in place. When the wet plaster dries, the face is sanded so that it is flush with the remainder of the wallboard 24.

Figure 8:
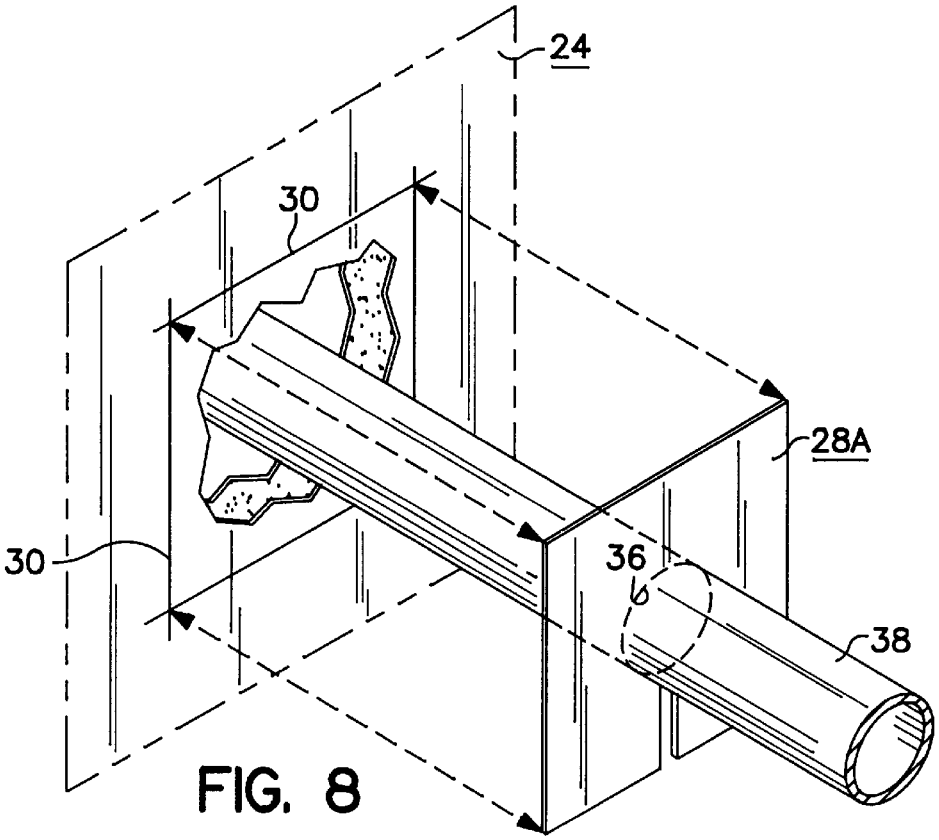
FIG. 8 is an exploded isometric view showing the sizing of the opening for a conduit.
Figure 9:
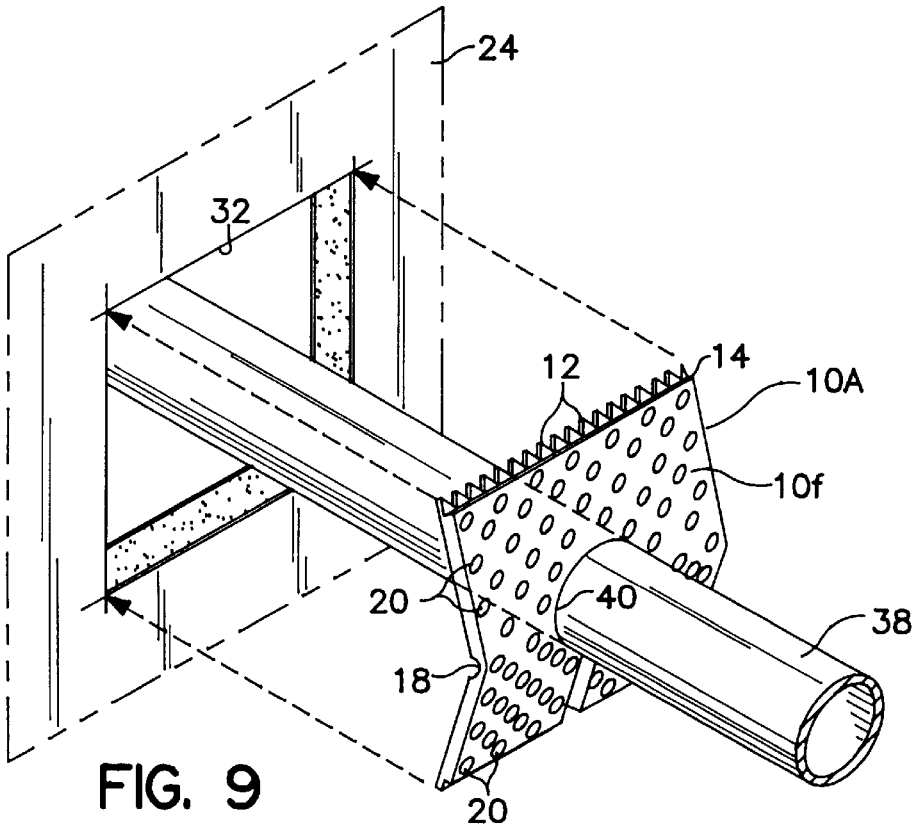
FIG. 9 is an exploded isometric view showing the sized opening about a conduit in the drywall and a slightly modified patch device prior to insertion within the sized opening.

FIGS. 8 and 9 show another use for a patch element in accordance with the present invention. The patch element 10 is generally designated by the numeral 10. This patch system is used, for example, in new construction, to provide a finished look for mounting conduit 38 extending through an opening in the wallboard or the like. Thus, the template $\mathbf{28}_a$ is generally the same as that described previously, except that it has a key-shaped opening 36 of a size to accommodate the conduit 38. The patch element $\mathbf{10}_a$ likewise is formed with a key-shaped opening 40 to fit over the conduit 38 in the manner shown in FIG. 9. The preparation of the site and the installation of the patch element 10 is essentially the same as described in connection with the principal embodiment and as shown in FIGS. 7A, 7B and 7C.

Figure 10:
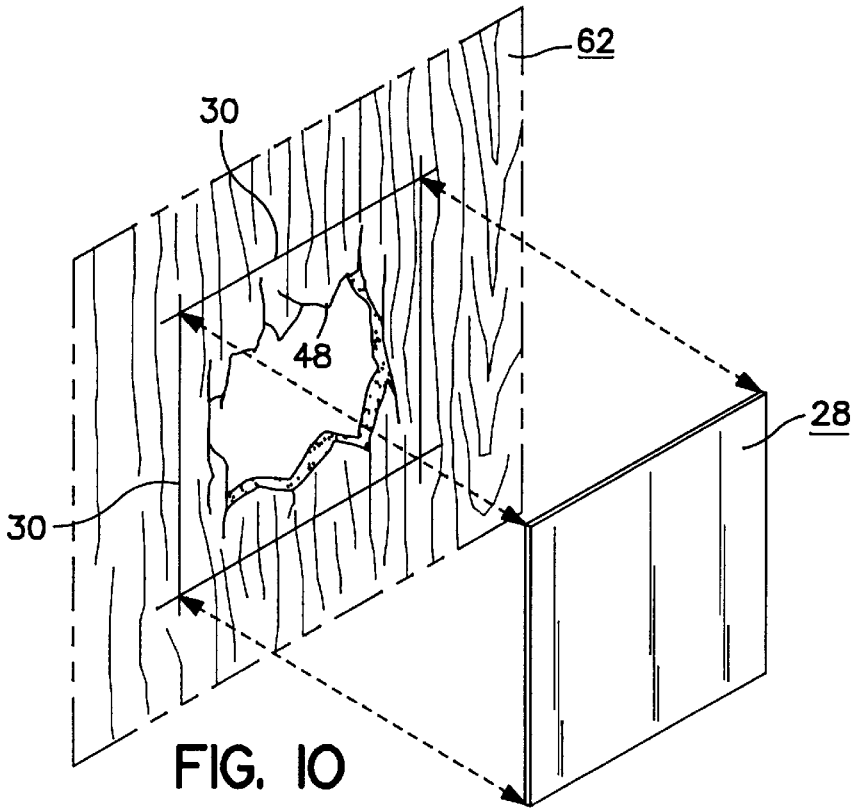
FIG. 10 is a perspective view similar to FIG. 5, showing the sizing of an opening in a wood panel, such as a panel of a door.
Figure 11:
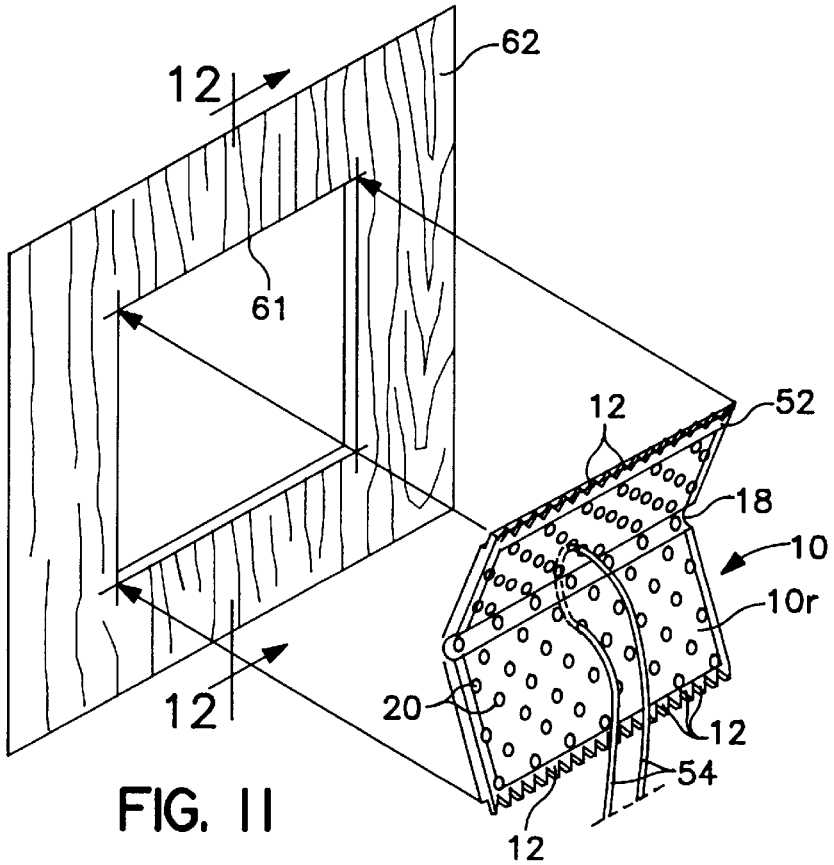
FIG. 11 is a perspective view similar to FIG. 6 wherein is an exploded fragmentary isometric view showing the sized opening in a wood panel prior to the insertion positioning and fixing of the patch device to the inner wall of the wood panel.
Figure 12C:
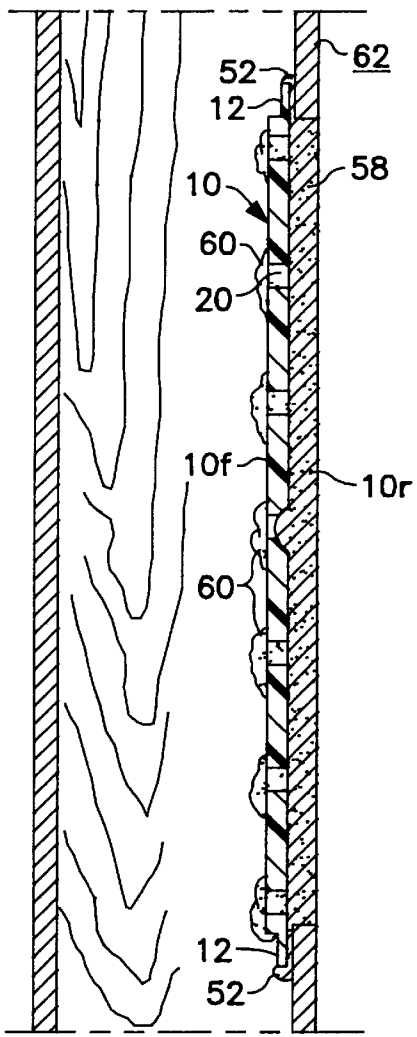
FIGS. 12A, 12B and 12C are enlarged transverse sectional views showing installation of the patch device of the present invention in the wood panel shown in FIGS. 10 and 11.
Figure 12B:
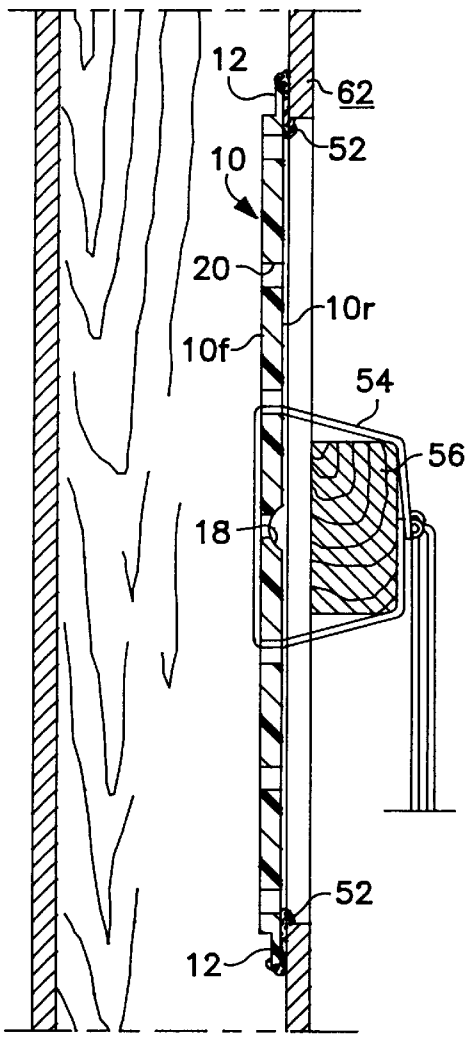
Figure 12A:
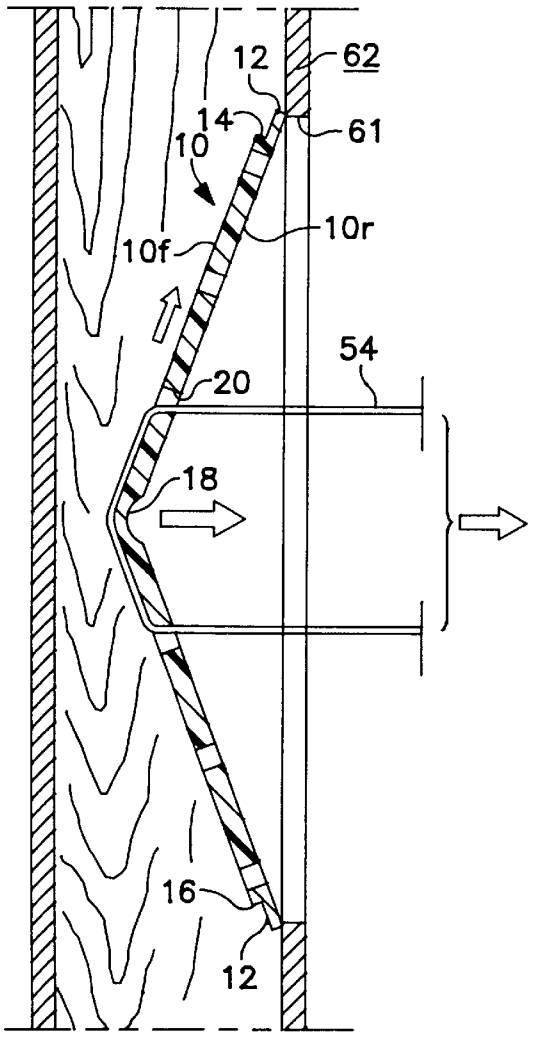

FIGS. 10, 11, 12*a*,12*b* and 12*c* inclusive, show another use for a patch element 10 in accordance with the present invention. In this instance, the patch element 10 is used to repair a puncture or opening 61 in a wooden panel 62, such as a hollow door panel or the like. In this instance a template 28 is used to define a generally square opening 61 in the damaged panel, as shown in FIG. 10. Thereafter a patch element 10 generally of the type described in connection with the principal embodiment of the present invention, is engaged through the opening 61. The periphery of the rear face $\mathbf{10}_f$ of the patch panel 10 is provided with an epoxy to hold it in place when positioned around the periphery of the square opening formed in the panel. FIGS. 12A, 12B and 12C inclusive show the assembly process. A length of string 154 may be used in connection with a cross-brace or beam 52 to assemble the flexed patch element and hold it in a flat state until the epoxy hardens around the periphery. Thereafter, the space S between the rear face $\mathbf{10}_r$ and the side edges of the panel are filled with a wood putty in much the same manner as wet plaster is used in connection with drywall or the like. When the wet plaster 58*a* is applied to the front face to cover the opening, a portion of the wet plastic flows through the opening to create the plaster nails 60.

Figure 13:
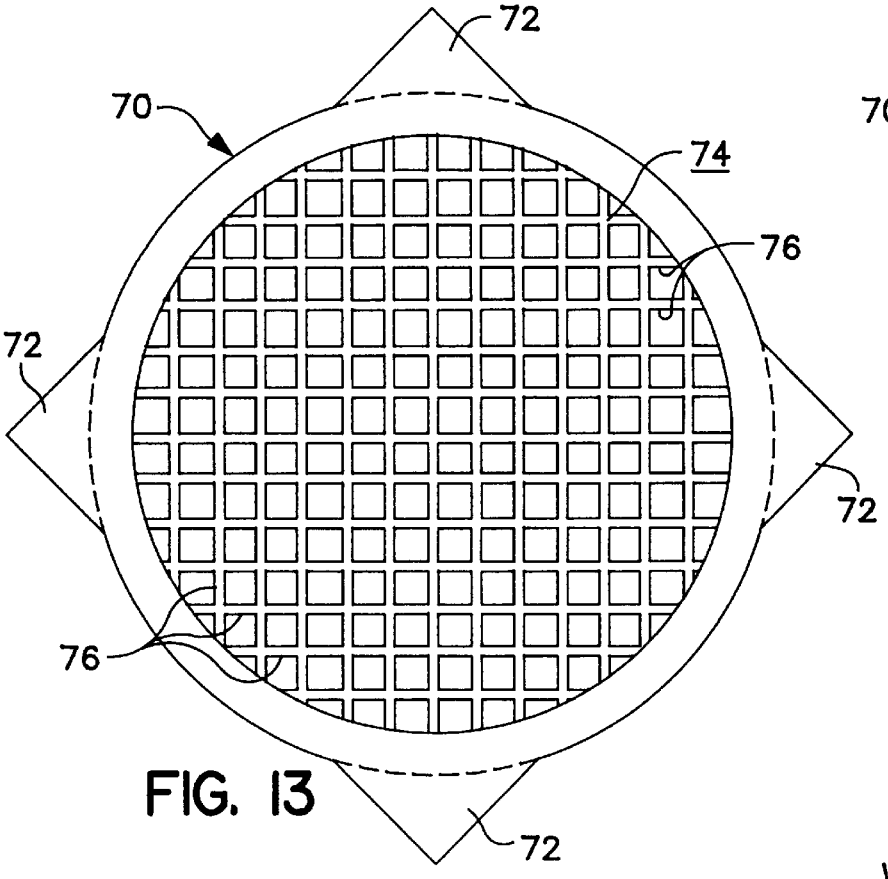
FIG. 13 is a plan view of another embodiment of the patch device in accordance with the present invention.
Figure 14:
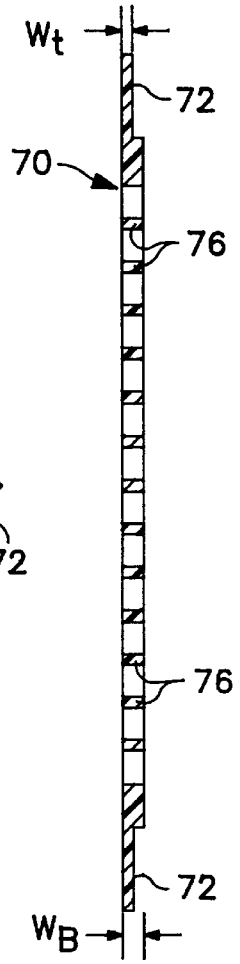
FIG. 14 is a sectional view taken on the line 14,14 of FIG. 13.

FIGS. 13 and 14 show a modified form of patch device in accordance with the present invention generally designated by the numeral 70. In accordance with this embodiment, the patch device 70 comprises a generally circular body portion 71 having a grid work 74 comprised of a plurality of square-through holes 76. A series of four circumferentially, equi-spaced triangular teeth project radially from the body portion. The teeth 72 as illustrated in FIG. 14 are of a width $W_t$ smaller than the width $W_B$ of the body portion 71.

Consider briefly use and installation of the patch device of FIGS. 13 and 14. The damaged drywall hole is trimmed to a suitable size for the patch device by using a template in the manner described above. The patch device has an inherent flexibility by reason of the material and the grid work is flexed to fit into the opening created in the drywall so that it is seated in much the same way as the principal embodiment and as shown in FIGS. 7A, 7B and 7C. The wet plaster is then applied to one face, the openings permitting the flow of plaster to create the plaster nails described above.

Figure 15:
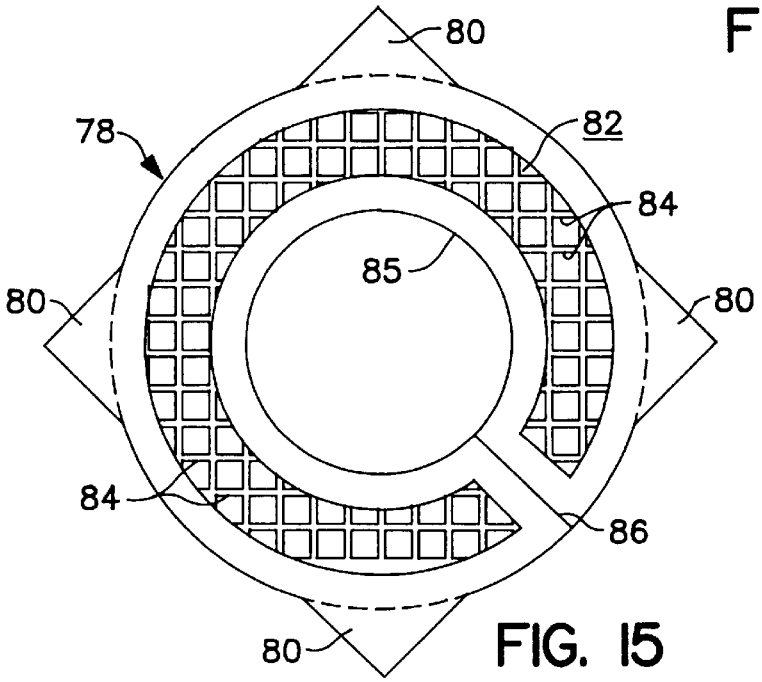
FIG. 15 is a plan view of an additional modification of the patch device used to repair damaged dry wall wares associated with conduits passing through drywall construction.

FIG. 15 shows another modification of patch device in accordance with the present invention. This embodiment is similar to FIGS. 13 and 14 and is adapted for use in supporting conduit in a wall opening in the manner previously described and as shown for example in FIGS. 8 and 9. In accordance with this embodiment, the body portion has a circular centrally disposed opening 85 and the annular portion surrounding the opening has a grid work 82 comprising of a plurality square-shaped openings 84 arranged in rows. The body portion is also split at 86 to facilitate positioning of the patch device over a conduit or the like in the manner shown in FIGS. 8 and 9. The patch device also has four circumferentially equi-spaced tooth-like projections 80.

Figure 16:
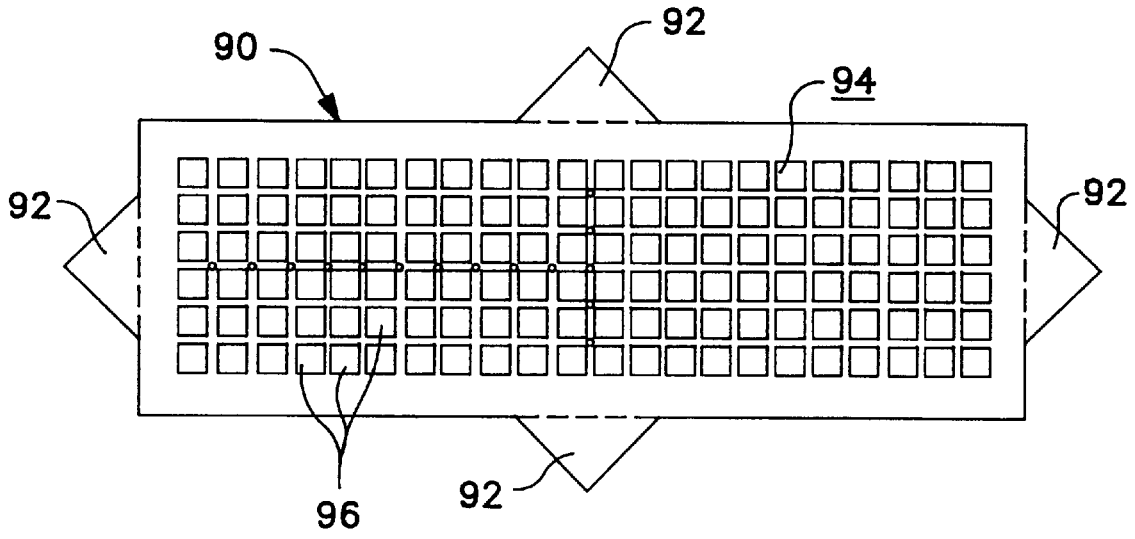
FIG. 16 is a plan view of still another modification of the patch device in accordance with the present invention.

FIG. 16 shows another modification of the patch device in accordance with the present invention generally designated by the numeral 90. In this instance, the body portion is rectangularly shaped and has a grid work 94 comprised of a series of square openings through holes 96. The patch device also includes triangularly-shaped teeth 92 which project from opposing side-edge portions, opposing ends of the patch device and opposing side edges.

Even though particular embodiments of the invention has been illustrated and described herein, it is not intended to limit the invention and changes and modifications may be made therein within the scope of the following claims.

What is claimed is:

1. A patch device for repairing an opening in drywall wherein the opening has at least one pair of straight-sided generally parallel edges, comprising:

a body portion made of a flexible material having at least one pair of generally parallel spaced-straight sides;

a series of sharp projections defining a plurality of teeth extending from opposing sides of said body portion engagable in the pair of edges of the opening in the drywall; and means defining a hinge in one face of the body portion for flexing the body portion to facilitate engagement of the teeth in the opposing generally parallel side edges in the drywall opening and installation of the patch device in the opening in the drywall.

2. A patch device as claimed in claim 1, wherein said body portion includes a plurality of through-holes, including a row of holes aligned with said hinge means, said holes for receiving and forming plaster nails, when wet plaster is applied to a face of the patch device in a finishing process.

3. A patch device as claimed in claim 2, wherein at least one row of holes is formed in the body portion along said hinge means.

4. A patch device as claimed in claim 1, wherein said teeth are of a cross section less than a cross section of the body portion.

* * * * *